United States Patent [19]

Bender et al.

[11] Patent Number: 4,913,713

[45] Date of Patent: Apr. 3, 1990

[54] VERSATILE COUNTERTOP COOLER

[75] Inventors: Richard S. Bender, Canoga Park; Lawrence Pleet, Bell Canyon, both of Calif.

[73] Assignee: Riclar International, Encino, Calif.

[21] Appl. No.: 367,467

[22] Filed: Jun. 16, 1989

Related U.S. Application Data

[63] Continuation-in-part of Ser. No. 333,090, Apr. 4, 1989, Pat. No. 4,866,945, which is a continuation of Ser. No. 238,827, Aug. 31, 1988, abandoned.

[51] Int. Cl.[4] ..... F25B 21/02

[52] U.S. Cl. ..... 62/3.61; 62/3.64; 62/389; 62/395; 222/146.6

[58] Field of Search ..... 62/3.6, 389, 3.64; 222/146.6

[56] References Cited

U.S. PATENT DOCUMENTS

| | | | |
|---|---|---|---|
| 3,250,433 | 5/1966 | Christine et al. | 62/3.64 |
| 3,310,953 | 3/1967 | Rait | 62/3.64 |
| 3,314,242 | 4/1967 | Lefferts | 62/3.6 |
| 3,325,058 | 6/1967 | West, Jr. | 222/146 |
| 3,811,294 | 5/1974 | Taylor | 62/390 |
| 4,274,262 | 6/1981 | Reed et al. | 62/3.64 |
| 4,311,017 | 1/1982 | Reed et al. | 62/3.64 |
| 4,320,626 | 3/1982 | Donnelly | 62/3.64 |
| 4,346,562 | 8/1982 | Beitner | 62/3.6 |
| 4,757,920 | 7/1988 | Harootian, Jr. | 222/146.6 |

*Primary Examiner*—Lloyd L. King

*Attorney, Agent, or Firm*—Poms, Smith, Lande & Rose

[57] ABSTRACT

A countertop cooler for standard size water bottles where the plastic bottle has a spigot at the lower front end of said bottle which allows withdrawal of water, said water bottle enclodes in a refrigeration case for cooling; said refrigeration case having a removable top in which said bottle and removable top section of said cooler is held in place by a means for securing said removable section in place to close the refrigeration case. Within the refrigeration case is a metal conductive cooling surface member extending from the rear of said case extending along at least a substantial portion of the bottom and sides of said refrigeration case, cooling said water bottle by conduction, with a cooling means preferably thermoelectric incorporated within said cooler; and in engagement with the metal cooling surface member. The cooler preferably has foldable or extendable legs for selectively permitting the mounting of the cooler under kitchen cabinets, or raised for easier filling of tall receptacles.

20 Claims, 10 Drawing Sheets

FIG. 1
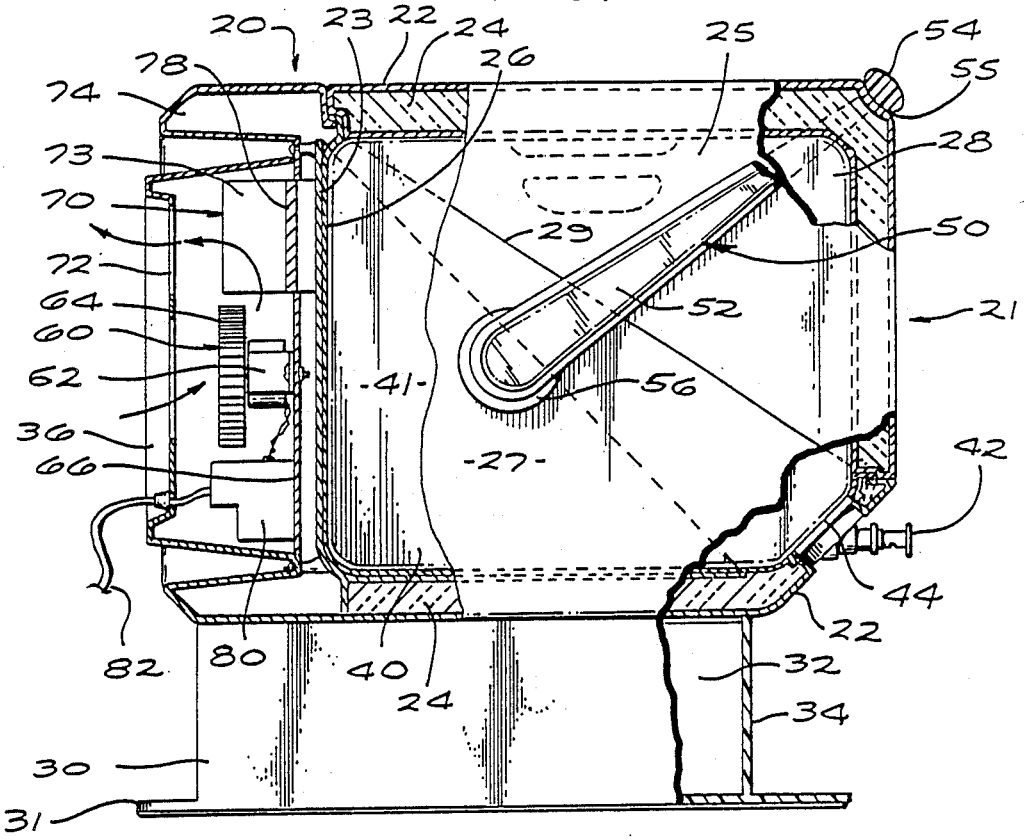
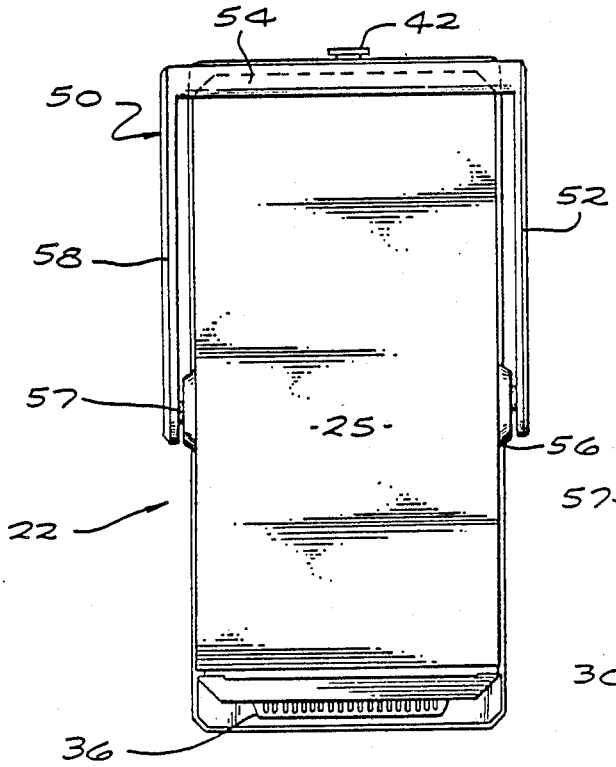
FIG. 2
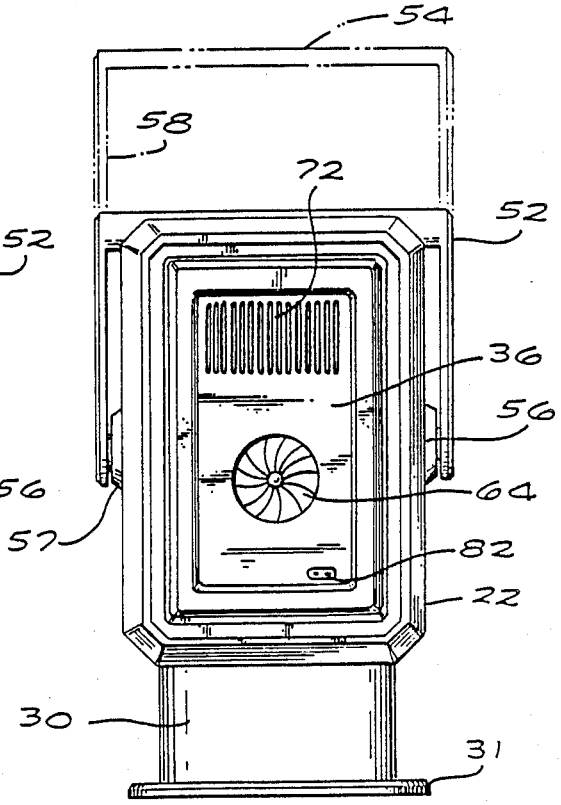
FIG. 3

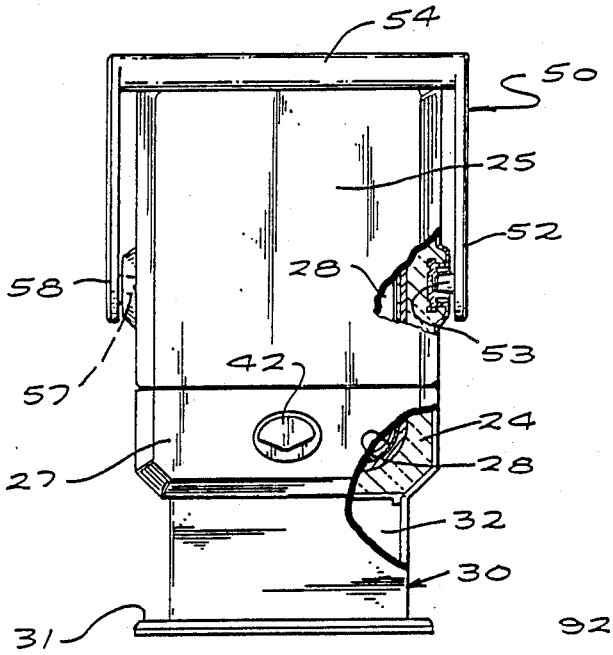
FIG. 4
FIG. 20
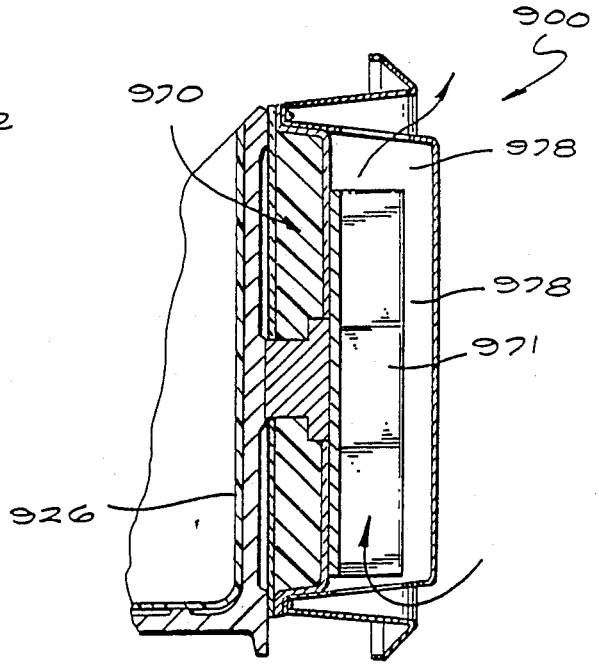
FIG. 21
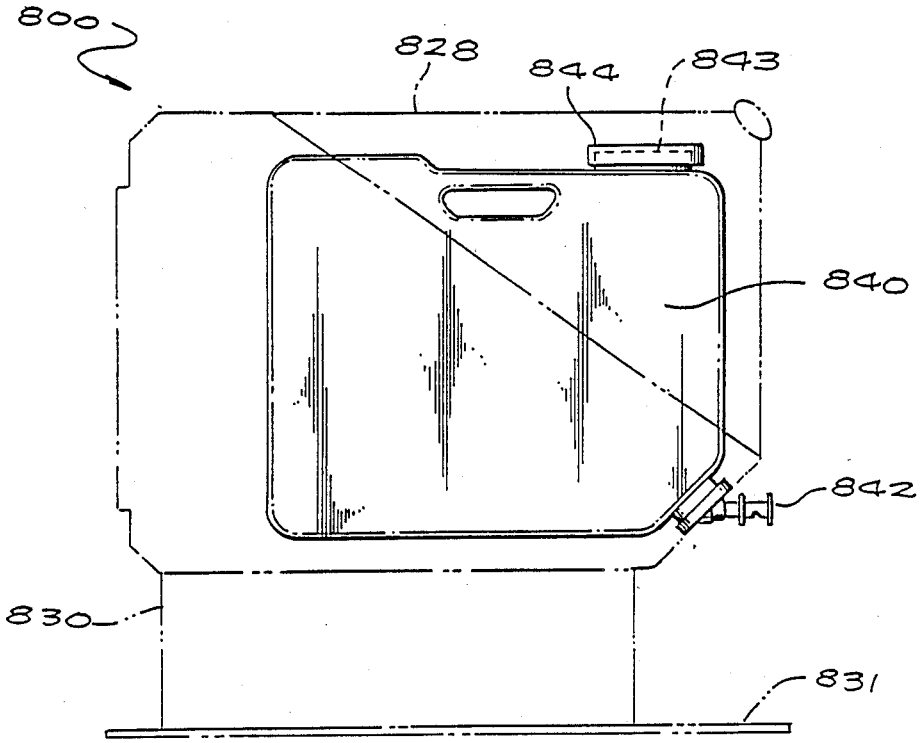

FIG. 5
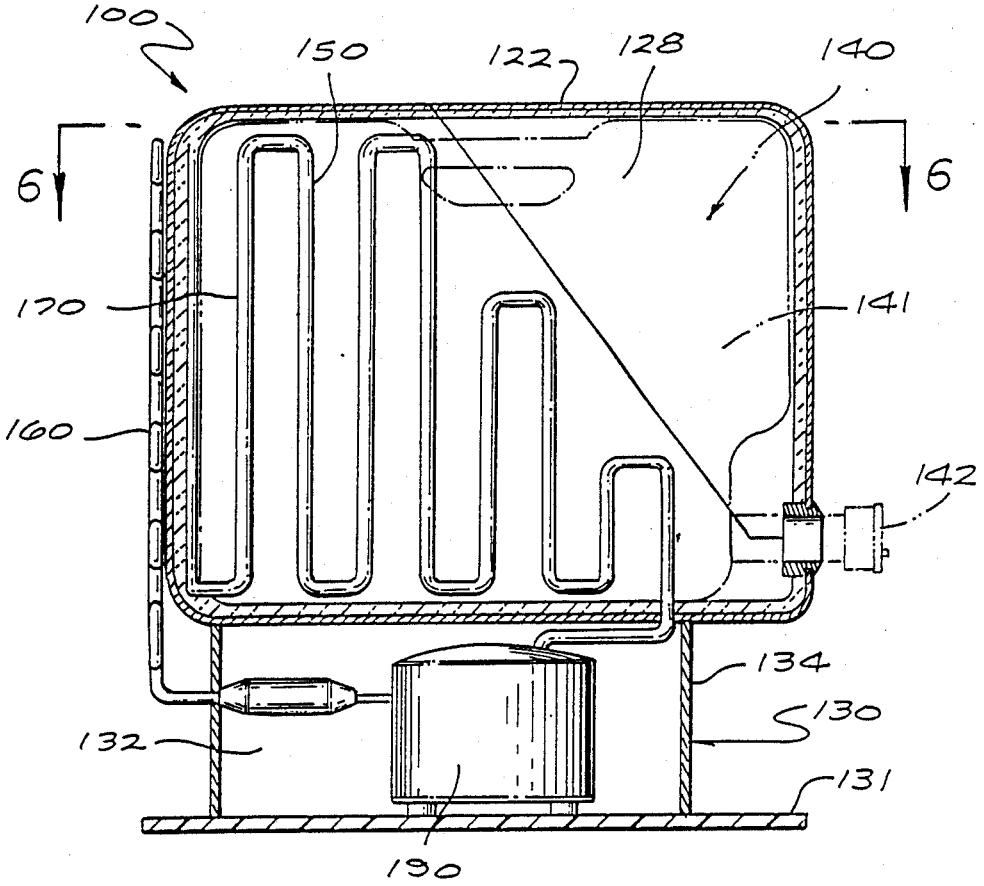
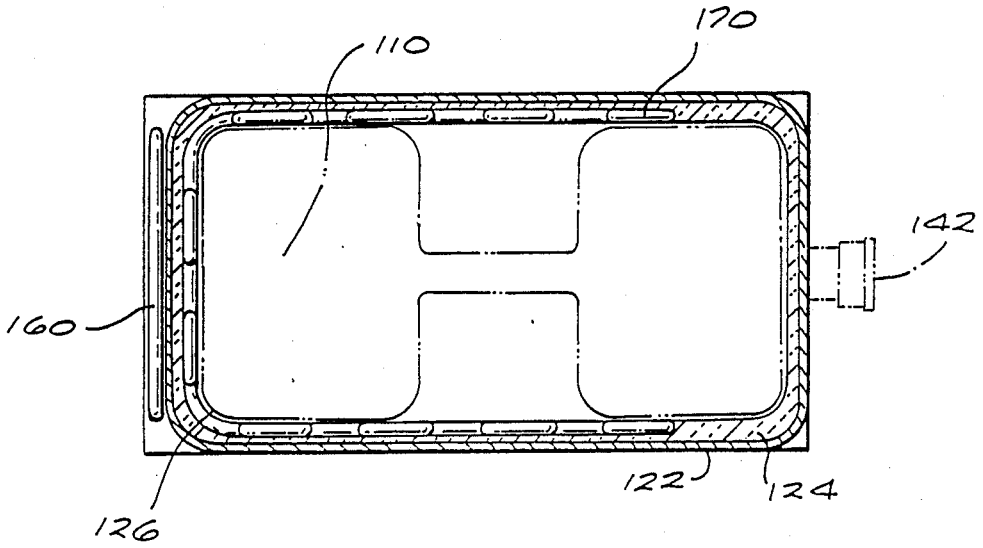
FIG. 6

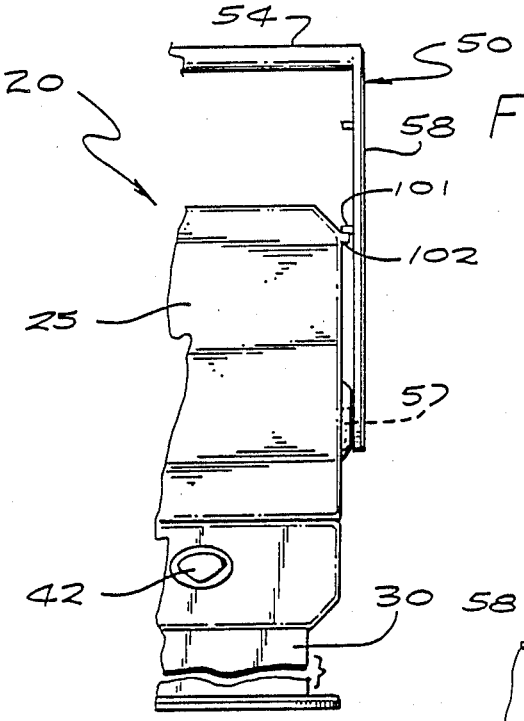
FIG. 14
FIG. 15
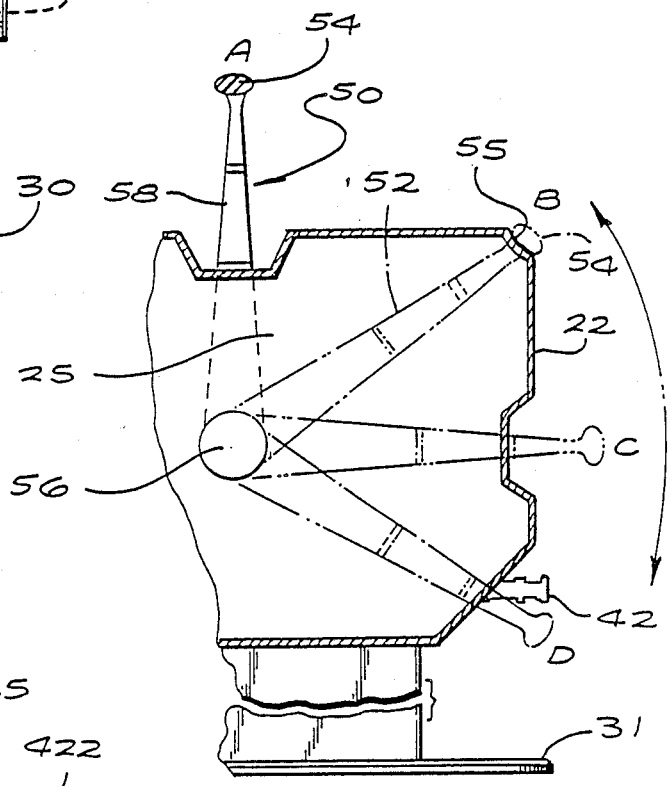
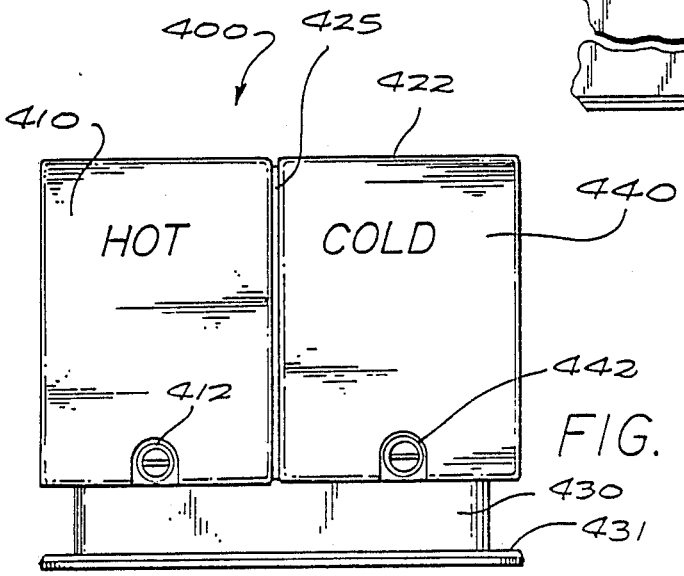
FIG. 16

VERSATILE COUNTERTOP COOLER

RELATED PATENT APPLICATION

This is a continuation-in-part of U.S. patent application Ser. No. 333,090, filed Apr. 4, 1989, now U.S. Pat. No. 4,866,945, which is a continuation of U.S. patent application Ser. No. 238,827, filed Aug. 31, 1988, now abandoned.

BACKGROUND OF THE INVENTION

The increased pollution of water systems throughout the country has created a tremendous demand for clean potable water of a known source. Health fears have risen as a result of the contamination of various domestic water supply systems with chemicals which either cause the closure of the system or increase the health risks to its users.

Stand alone water coolers have been known in the office environment for many years. Originally, purchased and utilized as a convenience, it has now become increasingly popular due to health fears concerning the piped in municipal water supply. In the home, there has been an increased demand for bottled water from a known source. The water has been typically sold as spring, mountain, purified, or distilled water. While the demand for bottled water has increased in the home, it has not replaced the convenience of tap water available from the municipal supplier.

Suppliers of spring water have attempted to supply the domestic user with water bottles and coolers like those found in the office environment. U.S. Pat. Nos. 4,646,944, 4,516,693, 4,373,647, 4,293,082, 3,966,093 and 3,843,021 are all variations on the office environment cooler, a stand alone unit which takes up unavailable floor space in the typical kitchen.

In supermarkets, two and one-half gallon plastic containers of spring water or purified water, with attached spigots, are now widely available. However, the consumer has had to store these bottles of water in their refrigerator, requiring the continual opening and closing of the refrigerator to obtain water. This inconvenience has resulted in many people doing without the bottled water. Additionally, the bottles themselves have been designed to hold large quantities of water and therefore occupy a large amount of space in the refrigerator.

The disadvantages of bottled water has resulted in less use than would occur if delivery of the water would be similar to that of the domestic tap. The invention herein obviates the above disadvantages of storing bottled water in the family refrigerator, as well as making its delivery for usage more practicable.

SUMMARY OF THE INVENTION

The invention may be summarized as a liquid chiller or countertop cooler for the standard sized plastic water bottles which are approximately 6 inches wide, 12 inches deep, and 10 inches in heiqht with the capacity of 2½ gallons. These bottles are provided with a spigot at the lower front end of the bottle, the spigot extending from the front of the cooler when said bottle is enclosed in the cooler refrigeration case. The refrigeration case has a removable section including a portion covering more than one-half of the top of said bottle and most of the front thereof which engages with a base section. This permits the easy placement of the water bottle in the refrigeration case and it also makes for easy removal of the water bottle therefrom. The removable section is held in place by a means such as a handle for securing said removable section in place to close said refrigeration case. Within said refrigeration case is a metal heat conductive member which is in the rear of the case and extends along at least a substantial portion of the bottom and sides of said refrigeration case. The metal conductor member cools said bottle by conduction; said cooling occurs through the use of a cooling means incorporated into the countertop cooler.

The countertop cooler may be provided with a thermoelectric cooling unit which is located at the rear of the cooler and which is in substantially direct cooling engagement with the metallic heat conducting member enclosing the rear of the water bottle. The thermoelectric cooling unit may have external fins at the rear of the unit, with these fins being cooled either by convection or with a supplemental air flow from a fan. The thermoelectric cooling is particularly adapted to the present cooler system in which cooling is accomplished by direct heat flow through thermal conduction.

Other features and aspects of this invention may selectively include the following:

1. A pivoted locking handle which may engage the front upper corner of the unit to firmly hold the removable section in place, and may be provided with additional detents which engage mating protrusions or recesses on the removable section near the top and near the front of the removable section of the cooler. The handle may be used for carrying the cooler or moving it around on a counter.

2. The cooler may have a conventional compressor type cooling unit instead of a thermoelectric unit, with the cooling coils of the cooler closely enclosing the rear, sides, and bottom of the plastic water bottles which are to be cooled.

3. The cooler is preferably provided with a base which raises the water bottle above the counter by a few inches, with the total height of the cooler unit being less than 16 inches, so that it may be slid under the usual kitchen cabinets. The front of the cooler may be advanced to near the edge of a counter to facilitate filling tall receptacles.

4. Hot and cold units may be combined in single side-by-side assembly with the thermoelectric element heating one of the units and cooling the other one.

5. A reusable two and one-half gallon rectangular plastic bottle may be used, with a large removable cap, preferably with screw threads, on the forward portion of the bottle, and with the overall configuration of the bottle otherwise substantially that of the presently available bottles of water mentioned above. Any suitable beverage, such as iced tea, mineral water or any other potable liquid may be cooled in these units.

6. The countertop cooler unit may be provided with legs which raise the unit a few inches above the surface on which it is resting, to provide flexibility in using the cooler. In some cases where the unit is to be located on a countertop under cabinets, the clearance may be such that the legs should be folded under the unit. In other cases where there is adequate vertical clearance, the legs may be used to raise the unit so that taller glasses or other receptacles may be more easily filled with the unit located back from the edge of the surface on which it is mounted.

7. The thermoelectric cooling element may be in direct thermal engagement with a thermally conductive sheet metal member which extends along at lest two walls of the cooler unit, preferably the inner walls thereof, for increased thermal efficiency. This sheet metal member may be formed of bright, anodized aluminum, and may extend from the back of the unit where the thermoelectric element is mounted, and may extend from the back along the bottom wall and/or the side walls of the unit.

8. The edges of the removable top section and the fixed bottom section of the cooler may be provided with a mating grooved and ridged configuration, so that the top section will normally rest firmly and in heat confining relationship onto the bottom section of the cooler.

9. The cooler may be provided with a tight fitting plug to seal the opening through which the water bottle spout would normally extend, so that the cooler could be used for cooling other food stuffs instead of, or in addition to, liquids.

10. Alternate air flow paths may be provided, with a fan blowing warm air from the thermoelectric cooling fins either both up and down, or solely toward the top of the unit from a bottom inlet.

Other objects, features and advantages of the invention will become apparent from a consideration of the following detailed description, and from the accompanying drawings.

BRIEF DESCRIPTION OF THE DRAWING

FIG. 1 is a side view of a countertop cooler illustrating the principles of the present invention;

FIG. 2 is a top view of the countertop cooler of FIG. 1;

FIG. 3 is a rear view of the countertop cooler of FIGS. 1 and 2;

FIG. 4 on sheet 7 of the drawings is a front view of the countertop cooler of FIGS. 1-3;

FIG. 5 is a cut-away cross-sectional view showing a countertop cooler using a conventional compression type refrigeration system;

FIG. 6 is a cross-sectional top view through plane VI—VI of FIG. 5;

FIG. 14 is a cutaway showing one locking position of the lock handle utilized to secure the removable section of the refrigeration case of FIG. 1, to the base thereof;

FIG. 15 illustrates the multi-position locking capability of the lock handle of the countertop cooler of FIG. 14;

FIG. 16 illustrates a side-by-side case holding two plastic bottles of water, with the left side holding hot water and the right side holding cold water and energized by a thermoelectric unit;

FIG. 20 illustrates convection air flow through the rear of a thermoelectric embodiment of a cooler;

FIG. 21 is a schematic showing an embodiment of a countertop water cooler with a refillable plastic bottle and spigot system;

DETAILED DESCRIPTION

Figure 7:
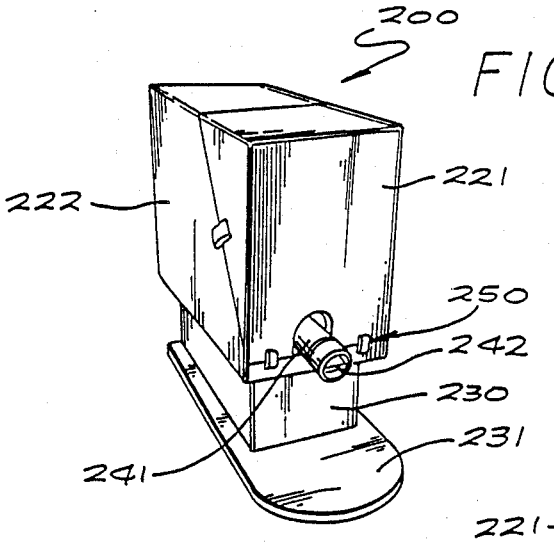
FIG. 7 is a front perspective view of an alternative embodiment of a countertop cooler illustrating the principles of the invention.

Referring to FIG. 1 of the drawings, countertop cooler 20 is shown in a side view with cutaway cross-sections. The countertop cooler 20 has an upper enclosure case 21 with an exterior surface 22, an interior cavity 28 into which water bottle 40 fits, and an interior thermally conductive liner or surface 26 in intimate contact with bottle 40. The enclosure has insulation 24 between exterior surface 22 and interior thermally conductive surface 26, typically a conductive plastic or metallic liner which is in intimate contact with water bottle 40 and covers a conductive metal member 23 preventing the contact of moisture thereon. The conductive member 23 and liner 26 contour to the approximate shape of bottle 40, exclusive of the bottle's top surface. The water bottle 40 fits into enclosure area 28. Spigot 42 which is part of the standard plastic water bottle 40, enables the water 41 to be drained from bottle 40. The water bottle 40 sits within upper enclosure case 21 on base 30 which has a lower flange 31. Base 30 is constructed with a thin sidewalls 34 and an interior cavity 32 within base 30, which may be employed for the storage of cups or for the mounting of ancillary components.

The upper front of the unit 21 is a removable section 25, to permit the mounting and removal of the 2½ gallon bottles 40. Removable section 25 is held in place by lock handle 50. With the lock handle 50 as shown in FIG. 1, the removable section 25 is very securely held in place, by the engagement of the lockbar portion 54 of handle 50 with the recess 55 in the upper front corner of section 25. A lower section 27 which partially encloses water bottle 40 mates with the removable section 25 along mating line 29. The annular position of lock handle 50 will determine the removability of section 25, as discussed in greater detail hereinbelow. The embodiment shown in FIG. 1 utilizes a thermoelectric cooling device 70 mounted on the rear of the countertop cooling unit 20. Thermoelectric cooling device 70 is mounted in the rear wall of upper enclosure 21 to ensure intimate contact with the aluminum heat transfer liner 23 (discussed below) and the interior thermally conductive liner 26. The thermoelectric module 78 forming part of unit 70, as utilized herein may be purchased from Material Electronic Products Corporation of Trenton, N.J. Optional spacer 74 of thermally conductive metal is mounted between thermoelectric module 78 and conductive plate 23. The thermoelectric cooling device 70 provides a solid state thermoelectric cooling system for cooling the conductive plate 23 and liner 26 which draws heat out of the water 41 in plastic water bottle 40, causing water 41 to cool, while concurrently heating fins 73 which extend to the rear. The centrifugal fan system 60 pulls air through screen back plate 36 and draws heat away from the fins 73 of thermoelectric device 70 and expels air through flow area 72. Electrical power is supplied to the electric fan motor 62 by transformer 80 from wire 82. Fan motor 62 and transformer 80 are supported on mounting plate 66. Seal 44 prevents leakage of air between interior cavity 28 and the ambient air, around spigot 42.

FIG. 2 is a top view of the countertop cooling unit 20 shown in FIG. 1. FIG. 2 specifically shows the locking handle 50 with its side elements 58 and 52 which are mounted to axial mounts 57 and 56. The locking bar 54 of handle 50 is locked at the upper front corner of the removable upper section 25.

FIG. 3 shows a rear view of cooling unit 20 of FIG. 1. This view illustrates the back end airflow panel 36 and fan blades 64, as well as base 30 and its lower flange or base plate 31.

FIG. 4 on sheet 7 of the drawings is a front view of countertop cooling unit 20, shown in FIGS. 1–3. Illustrated is spigot 42, insulation 24, and interior area 28. Additionally, lock handle 50 with side bars 52, 58 and lockbar 54 are shown with bearing 53 associated with side bar 52 in cross section. The position shown is that which locks removable section 25 in intimate mating contact with lower section 27, as shown in FIG. 1.

FIG. 5 is a side view in cross section of an alternative embodiment 100 of the invention herein. The countertop cooling unit 100 utilizes conventional refrigeration unit 150 which has a compressor 190, which fits within base cavity 132, evaporation cooling coils 170, and condensing coils 160. Within the traditional refrigeration system the evaporator 170 pressurized with refrigerant is allowed to expand, boil and evaporate. During the change of state from a liquid to a gas, energy, in the form of heat is absorbed. Compressor 190 is the refrigerant pump and recompresses the gas back into a liquid. Condenser 160 expels the heat absorbed by the evaporator plus the extra heat added by compressor 190 to the environment or ambient. The operation of conventional refrigerating unit enables a cooling of the water 141 in plastic water bottle 40.

Concerning my reference numerals employed in the present specification, in FIGS. 1–4, certain reference numerals for parts such as base 30 and water bottle 40 were employed; and in FIG. 5 these parts bear reference numerals with a different prefix, i.e., base 130 and water bottle 140. More generally, throughout the present specification the same reference numerals will be employed, for corresponding parts in different embodiments, but with a different prefix digit in the "hundreds" column.

FIG. 6 is a top view taken along plane VI—VI of FIG. 5, of the countertop cooling unit 100 utilizing a conventional refrigeration unit 150. The plastic water bottle 140, evaporating coils 170, condensing coils 160, and thermally conductive inner liner 126 are shown.

The embodiment shown here, as in that of FIGS. 1–4, require that the water bottle be placed into the enclosure by spigot first. Each of the drawings show the requirement that spigot 42 in FIG. 1, spigot 142 in FIG. 5, have to be inserted first, and then the rest of the plastic water bottles 40 and 140, follow into cavities 28 and 128 respectively.

FIGS. 7 through 10 show another alternative embodiment 200 wherein front section 221 is readily removable leaving the water bottle 240 resting within section 222 which is supported by base 230 which sits on base plate 231. Retention tabs 250 may be provided to hold the removable section 221 in place. The removable section 221 has a central notch to accommodate spigot 242.

Figure 8:
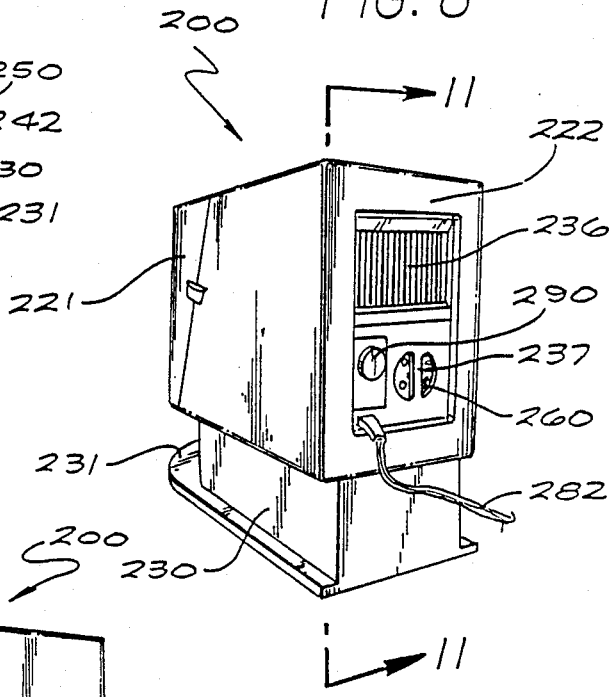
FIG. 8 is a rear perspective view of the countertop cooler of FIG. 7.

FIG. 8 shows the rear of unit 200, which has fan 260 bringing in cool air through opening 237, exiting through opening 236, and the water being cooled by a thermoelectric cooling device (not shown) such as that of FIGS. 1–4. The flow of air from inlet 237 to grill 236 brings in cool air and expels warm air. Thermostat control 290 enables the setting of a specific degree of coolness to which the water will be cooled. Supply wire 282 brings the necessary power to the thermoelectric device (not shown).

Figure 9:
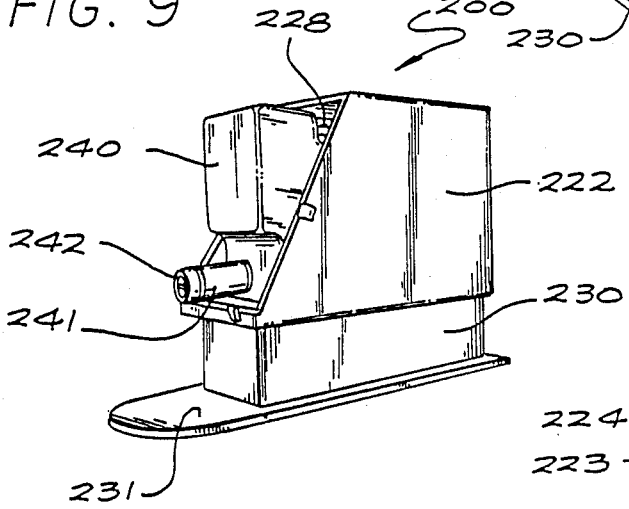
FIG. 9 shows the placement of a plastic water bottle into the countertop cooler of FIG. 7.

FIG. 9 shows the unit 200 with front cover section 221 removed, exposing water bottle 240.

Figure 10:
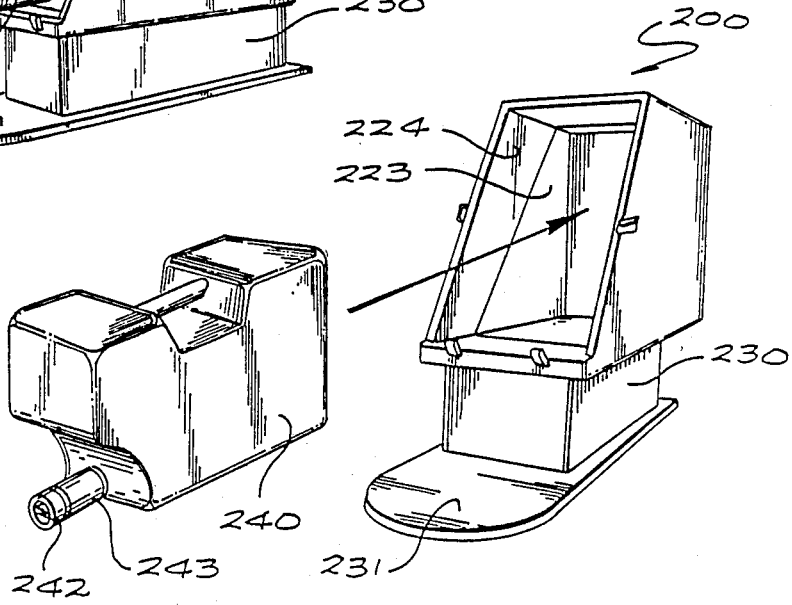
FIG. 10 illustrates a typical commercially available plastic water bottle shown as it would be mounted into the countertop cooler of FIG. 7.

FIG. 10 shows the entry of water bottle 240 into rear half 222, wherein conductive surface 223 cools the water, while insulation 224 maintains the water's temperature. In FIG. 10, the plastic liner is not shown for clarity in noting the shape of the partial box configuration of the aluminum member 223, which extends along the rear and substantial portions of adjacent wall or walls, and may include sides and/or the bottom of the unit.

Figure 11:
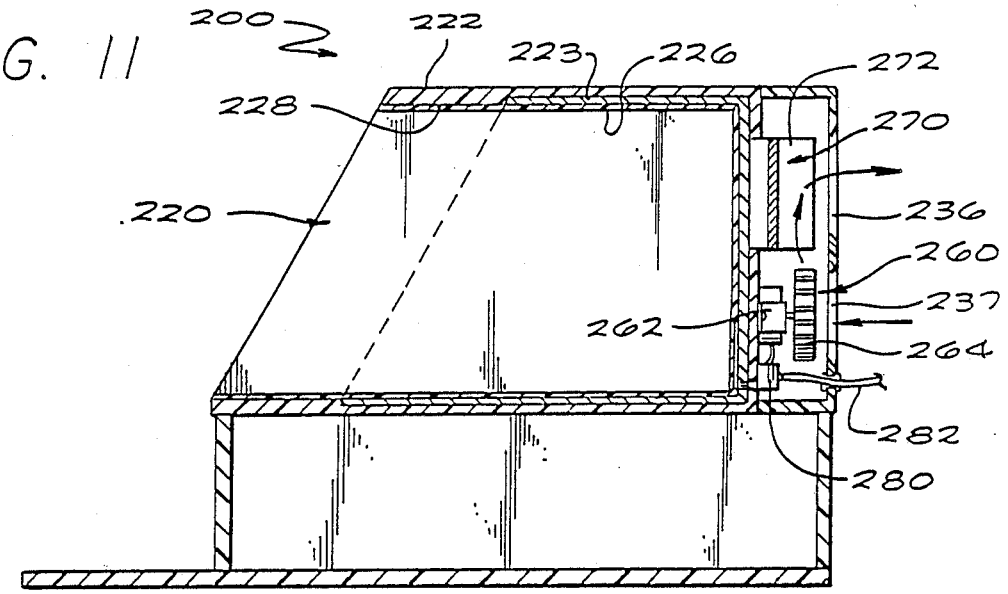
FIG. 11 is a side view in cross-section illustrating the use of a centrifugal fan to assist in cooling the fins of the thermoelectric cooling unit.

FIG. 11 is a view in cross-section of unit 200, illustrating the position of thermally conducting liner 226, and metal conductive cooling member 223 within rear enclosure 222, and the position of thermoelectric device 270 in intimate contact with metal conduction member 223. The thermoelectric cooling device 270 is provided with a centrifugal fan system 260, which brings air in by fan 264 through opening 237 and out through opening 236, drawing the heat from the rear fins 272 of thermoelectric cooling unit 270.

Figure 12:
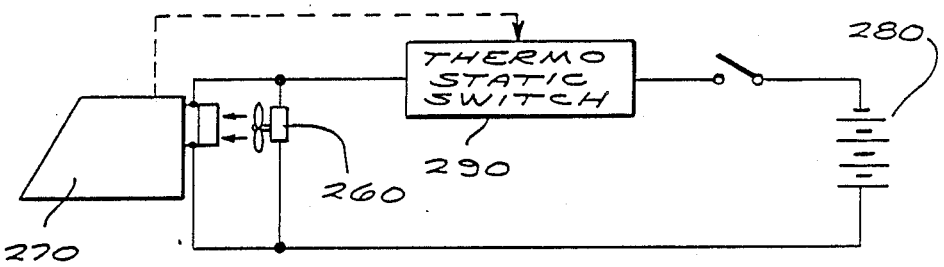
FIG. 12 is a schematic drawing of an electric circuit which may be employed in powering the thermoelectric cooling unit, and to maintain the degree of cooling at a predetermined temperature.

FIG. 12 is a schematic circuit diagram, showing cooler 220, the thermostatic switch 290, fan 260, thermoelectric cooling device 270, and a direct current power source 299. Instead of using battery 299, a step-down transformer and rectifier may be used.

Figure 13:
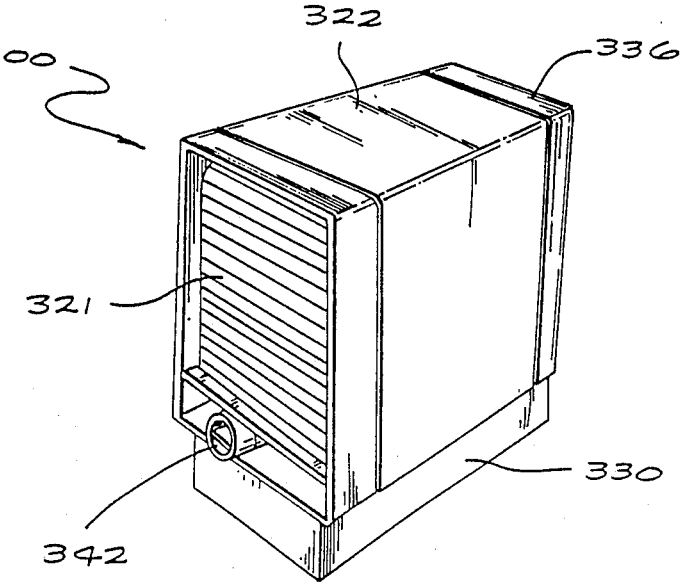
FIG. 13 shows a ribbed front incorporated in an alternative embodiment of a countertop cooler.

FIG. 13 is another alternative embodiment of the current invention 300 wherein the water bottle 340 (not shown) slides into section 322 and a closure 321 rolls down and closes the opening into which water bottle 340 slides. The closure 321 may be formed of a series of coupled slats as are used in a roll top desk.

FIGS. 14 and 15 show the multi-purpose positioning and locking provisions of lock handle 50, which may be used with the unit of FIGS. 1–4. More particularly, FIG. 15 shows the handle 50 in various positions. Position "A" is vertically oriented at 90° to base 31, and handle 50 holds upper section 25 in place by means of the contact of flanges 101 and 102 as shown in FIG. 14. Position "B" for lock handle 50 locks upper removable section 25 into place by means of the intimate contact of lockbar 54 with recess 55 in the front upper corner of removable section 25. Position "C" which is oriented at 90° relative to position "A" secures upper section 25 and allows for the easy sliding, pushing and pulling of the unit by handle 54 when in this position, with flange 103 on handle 50 interfitting with flange 104 on the upper portion 25 of the cooler case. Rotation through position "D", with clearance past spigot 42, allows the removal of upper section 25. It should be noted that in embodiment 100, utilizing a conventional refrigeration system, lock handle 50 as shown here in positions "A" and "C" could be an off position for a control switch for refrigeration unit 150. A rotary switch, mounted in handle mounting bosses 56 and 57 in unit 20, could activate the refrigeration unit 150 only at position "B". Additionally, position "D" in the conventional refrigeration system as shown by embodiment 100 would also trigger "Turn-off" the refrigeration unit 150 and allow removal of the upper removable unit.

FIG. 16 is another alternative embodiment, with the countertop unit 400 both cooling and heating water. The unit 400 would approximately be double the width of a cooling unit as shown in the prior embodiments. Cold water bottle 440, hot water bottle 410, in this front view would have the positions of hot and cold water handles on traditional water faucets. An additional section of insulation 425, separates the two bottles to prevent any loss of heat from bottle 410 or introduction of heat into bottle 440. Alternative embodiment 400 utilizes a single thermoelectric device to both cool bottle 440 as well as to heat bottle 410, so that the external fins and cooling arrangements shown on other embodiments are not needed. Separate thermoelectric units may also be used individually for the hot and cold units.

Figure 17:
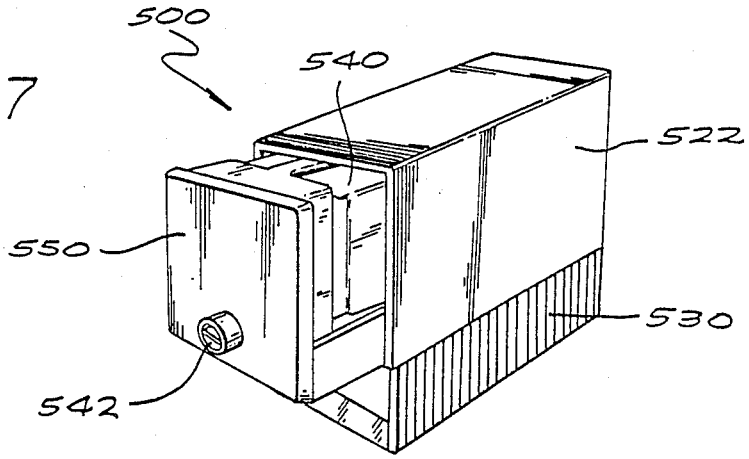
FIG. 17 is a countertop cooler which provides a sliding draw mechanism for removal and insertion of said plastic water bottle.

FIG. 17 shows an additional alternative embodiment of the invention herein, wherein the water bottle 540 is held on a drawer 550 which slides closed into enclosure 522. The cooling system is incorporated into the area of base 530 and could be either traditional or thermoelectric.

Figure 18:
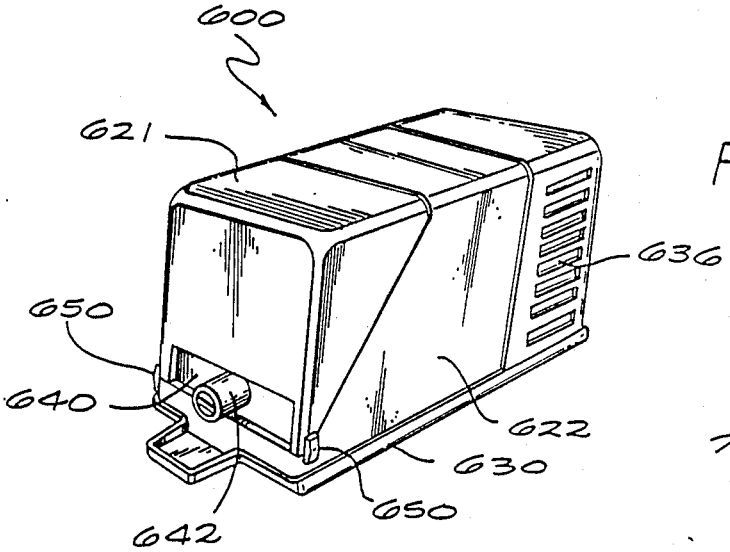
FIG. 18 is an embodiment of a countertop cooler with a conventional compression type cooling unit in the rear, and allowing a view of the water level.

FIG. 18 represents an additional alternative embodiment 600, wherein front section 621 sits on rear section 622. The bottle fits into bottom plate section 630. The cooling unit is in rear section 636. Unit 600 is contemplated as utilizing a traditional refrigeration system to cool the water; however, a thermoelectric unit may be employed.

Figure 19:
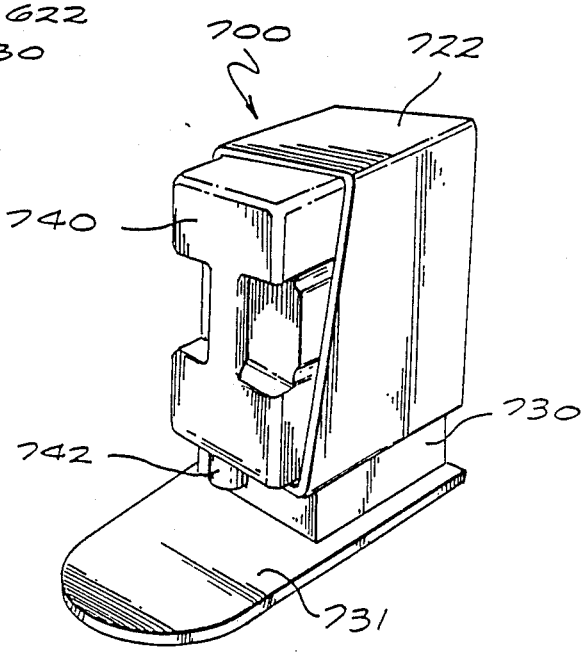
FIG. 19 is an embodiment of a countertop cooler with the cover removed, and which holds the plastic water bottle in a vertical orientation.

FIG. 19 shows another alternative embodiment 700 of the invention herein. Water bottle 740 is held in a vertical position in housing 722 mounted on base 730 and base plate 731. The position of bottle 740 provides for improved gravity water flow. A cover, not shown, encloses the front of the unit. This unit is preferably thermoelectrically cooled.

FIG. 20 is the cutaway rear section of a countertop cooling unit 900 using a thermoelectric cooling device 970 without a fan. The thermoelectric device 970 in the rear of unit 900 has ambient air flowing through opening 978 and through fins 971, to remove or carry off the heat generated by the thermoelectric unit 970. No fan is needed in view of the substantial exposed surface area of fins 971.

FIG. 21 is a schematical cross-sectional view of an embodiment of the current invention, wherein plastic water bottle 840 is held stationary within cavity 828. A large removable screw type cap 843 is provided. The cap may be two or three inches in diameter. Iced tea, water or other drinks are introduced into the container through opening 844, after removal of cap 843. This unit is envisioned for use in camping, as well as in areas in the country where bottled water is not sold in the type of container noted herein.

Figure 22:
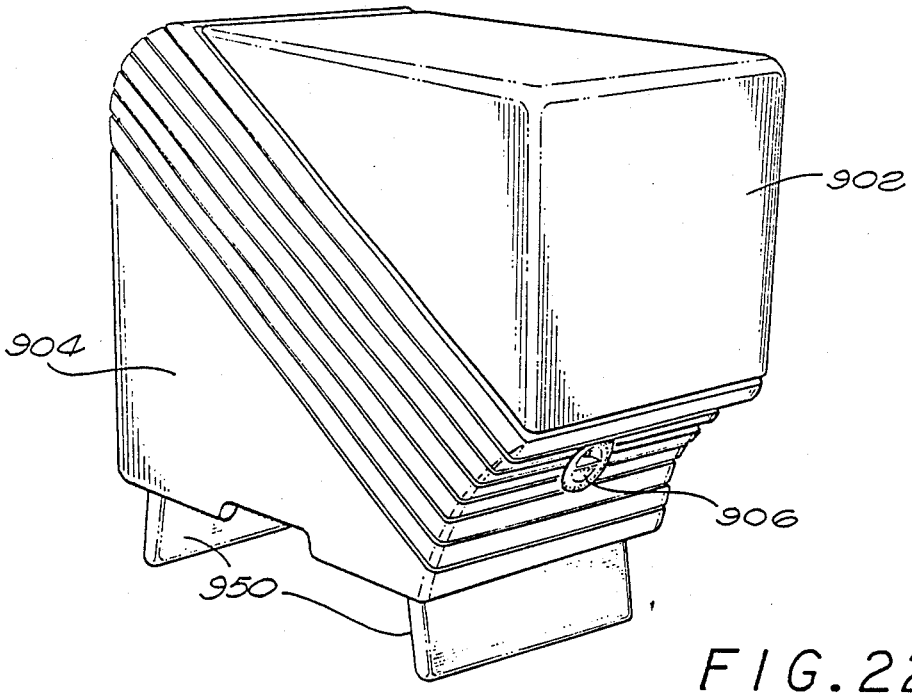
FIG. 22 is a perspective view of another embodiment of the invention, with the top section of the cooler closed.
Figure 23:
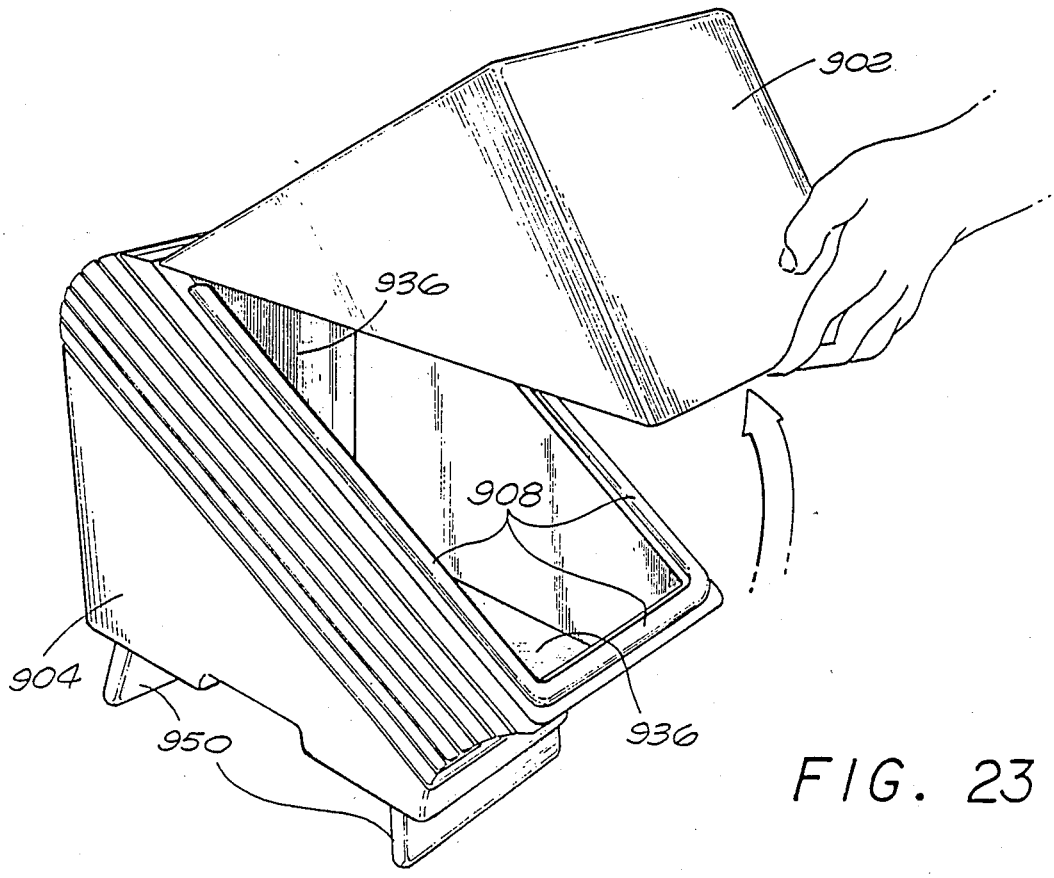
FIG. 23 is a perspective view of the unit of FIG. 22 with the upper section partially opened.

FIGS. 22 through 25 of the drawings show a presently preferred embodiment of the invention, FIGS. 22 and 23 being perspective views with the upper section 902 being shown closed with respect to the lower section 904 in FIG. 22, and raised in FIG. 23. It may also be noted that in FIG. 22, that a tightly sealing plug 906 is shown filling the opening through which the spigot of the water bottle would normally extend. The plug 906 may of course be removed, and a standard size water bottle placed within the countertop cooler. When the plug 906 is employed, it prevents the loss of cool air from within the countertop cooler, and permits its use as a small refrigeration unit for storing any desired substance, including miscellaneous food stuffs requiring chilling.

Figure 24:
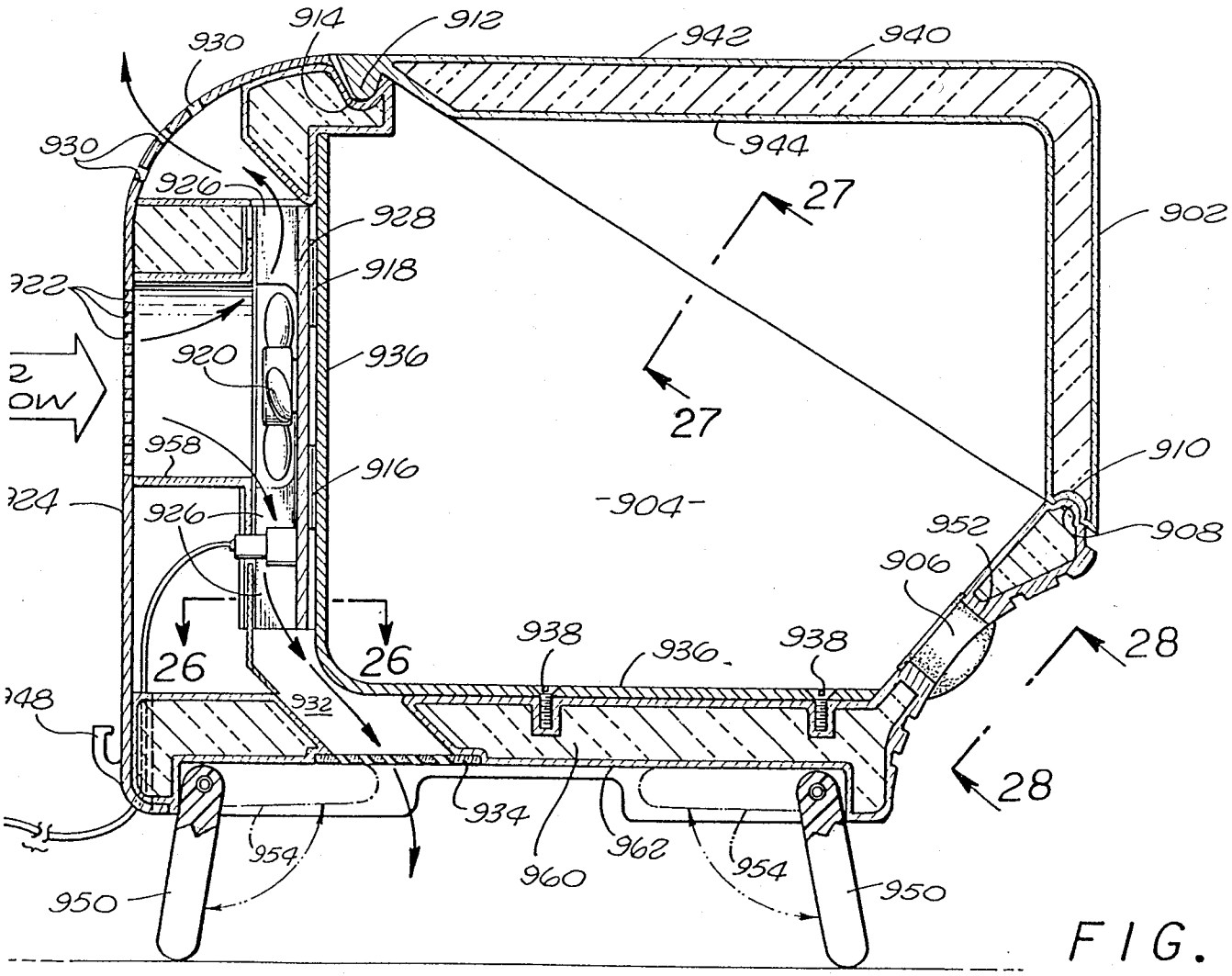
FIG. 24 is a cross-sectional view through the unit of FIGS. 22 and 23.

As shown to advantage in FIGS. 23 and 24, the upper portion 902 is seated on the ridge 908 which extends around three sides of the opening in the lower section 904 of the cooler. The upper section 902 of the cooler has a mating recess 910 which extends around three surfaces thereof, and has a downwardly directed ridge 912 which interfits with a corresponding recess 914 at the upper rear area of the unit, as best shown in FIG. 24. Two commercially available thermoelectric cooling elements 916 and 918 may be employed, and the fan 920 draws air in through the openings 922 in the rear plate 924 of the unit. The air which is drawn in is circulated past the fins 926 which are affixed to the plate 928 which is part of the hot junction of the thermoelectric cooling units 916 and 918. It may be noted that in the arrangement shown in FIG. 24, the warm air which has passed over the fins 926 is directed both upwardly through the openings 930 in the back plate 924 and downwardly through the channel 932 and the openings in the lower closure plate 934.

In intimate thermoconductivity with the cold junction of the thermoelectric elements 916 and 918 is the thermally conductive member 936 which may be bent to extend along the bottom, or either or both of the two vertical walls of the lower section of the cooling unit. The member 936 may be of sheet aluminum, anodized to maintain a high gloss. It may be secured to the insulating bottom wall of the lower section of the cooler by screws 938.

The walls of the countertop cooler may be formed in a conventional manner, with lightweight insulating materials, preferably of a foamed nature, forming the central portion 940 of the walls, and with an outer layer 942 and an inner layer 944 of somewhat higher density material to afford protection and abrasion resistance to the walls. For the high efficiency cooling of the contents of the cooler, the aluminum member 936 may be exposed; or alternatively, it may have a thin layer of a high thermal conductivity plastic, covering it, as shown in some of the other embodiments of the invention.

The unit may be powered from the alternating current normally supplied at 110 volts, 60 cycles in a home or office, as indicated by the plug 946 and associated cord, which may be stored on the hook 948. A step-down transformer and a rectifier may be employed. Alternatively, the unit may be powered from a direct current source or a battery, as discussed hereinabove.

The legs 950 may be extended, as shown in FIG. 24, to raise the unit so that a taller glass or other receptacle may more easily fit under the spigot which would extend through the opening 952, when a water bottle is mounted in the unit. Alternatively, the legs may be retracted to the location indicated by the reference numeral 954 to reduce the vertical extent of the unit, so that it may fit more readily under the cabinets in a countertop location. Countertop cabinets are normally about 15½ or 16 inches above the counter, and with the legs in the extended position, as shown in FIG. 24, the unit would not fit under some kitchen cabinets. It is also convenient and more compact for packaging or transporting the unit, to have the legs in the retracted position as shown at reference numeral 954.

Figure 25:
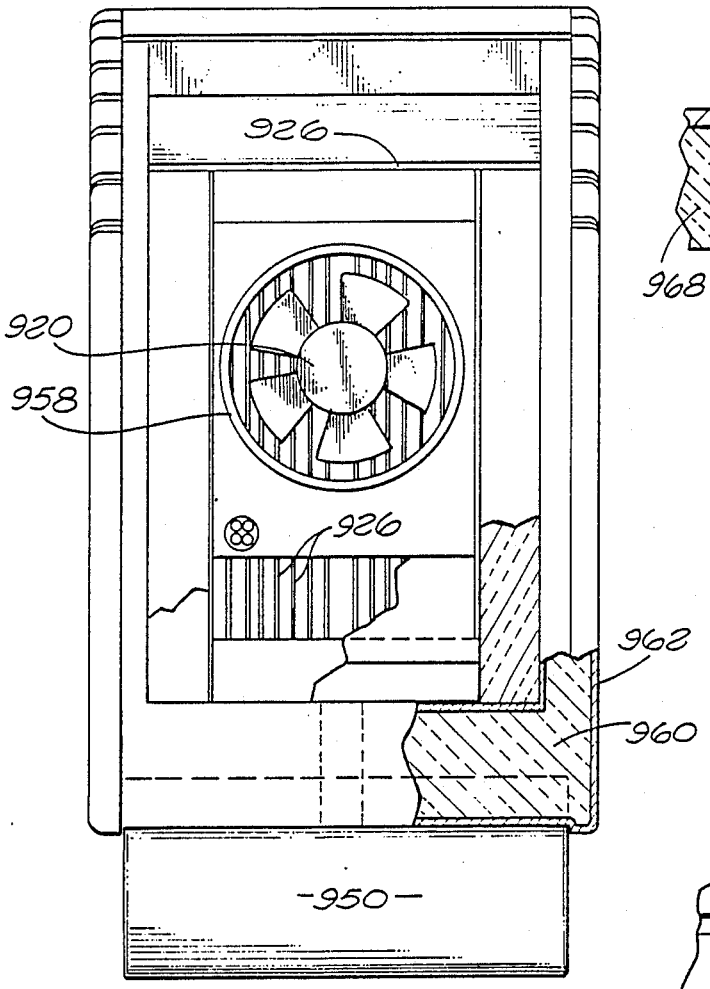
FIG. 25 is a rear view of the cooler of FIGS. 22 through 24 with the rear cover plate removed.

FIG. 25 is a rear view of the unit with the rear cover 924 of FIG. 24 removed, and part of the remaining structure being shown cut away. Visible in FIG. 25 is the fan 920 and the enclosing cylindrical duct 958 which guides the air being drawn in through the openings 922 in the rear cover 924, as shown in FIG. 24. The vanes 926 which serve to cool the hot junction of the thermoelectric cooling units are visible in part in FIG. 25. The outlet from the upper exhaust duct 928, is also indicated in FIG. 25. The insulation 960 of relatively low density foamed plastic material and the surface layer 962 of higher density, abrasion-resistant material, such as a high strength plastic, are also shown in FIG. 25.

Figure 26:
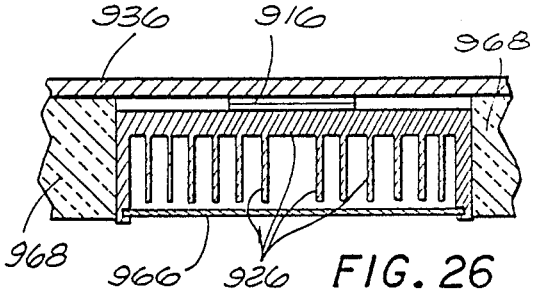
FIG. 26 is a detailed cross-sectional view taken along the plane indicated by line XXVI—XXVI in FIG. 24.

FIG. 26 is taken along plane indicated by the lines XXVI—XXVI in FIG. 24. More specifically, the thermoelectric unit 916 is shown in engagement with the inner conductive member 936 at its cold junction, with the hot junction of the thermoelectric element 916 being in engagement with the cooling fin structure 926. The panel 966 directs the air from the fan 920 along the vanes 926, to insure high efficiency cooling. The insulating walls 968 are adjacent to the fin structure 926.

Figure 27:
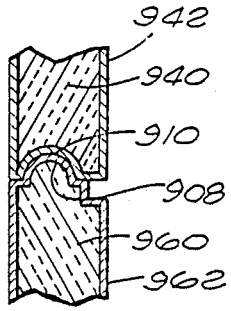
FIG. 27 is a cross-sectional view through the mating side edges of the upper and lower sections of the cooler, taken along the plane indicated by the line XXVII—XXVII in FIG. 24.

FIG. 27 of the drawings is a cross-sectional view taken along the plane at one of the edges of the cooler unit, as indicated by the lines XXVII—XXVII in FIG. 24. The insulated walls have a recess 910 in the upper or removable portion of the unit, and a matching protrusion 908 on the lower section of the countertop cooler.

Figure 28:
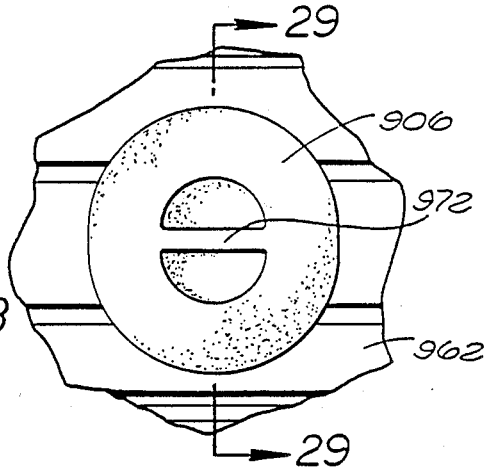
FIG. 28 is a view showing a plug for sealing the cooler when it is not used for cooling water bottles.
Figure 29:
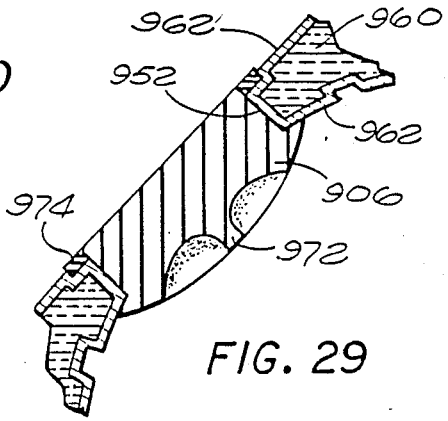
FIG. 29 is a cross-sectional view taken along the plane indicated by line XXIX—XXIX in FIG. 28.

FIG. 28 is an enlarged view of the plug 906, taken along the plane indicated by the line XXVIII—XXVIII of FIG. 24. FIG. 29 is a cross-sectional view through the plug 906, as indicated by the line designated XXIX—XXIX in FIG. 28. In FIG. 29, the plug 906 is shown as having a central ridge 972 by which the plug be grasped and removed. In addition, the plug has an inner flange 974 of resilient material in hold it in place within the opening 952.

Figure 30:
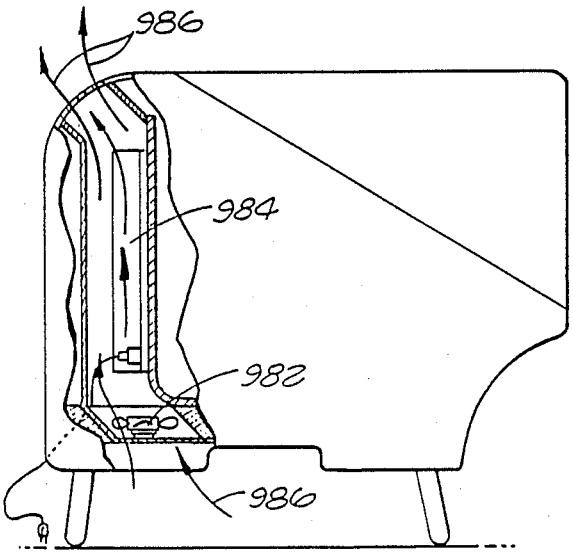
FIG. 30 is a side view of a countertop cooler unit showing an alternative air flow channel.

FIG. 30 shows an alternative air flow configuration, in which a fan 982 is mounted at the lower rear of the unit to direct air upwardly over the vanes 984 associated with the hot junction of the thermoelectric cooling assembly. The air flow is indicated by the arrows 986. Apart from this different air channel, the countertop unit of FIG. 30 is substantially the same as the unit previously described in connection with FIGS. 22 through 29.

Returning to the embodiment of FIGS. 22 through 29, the legs as shown in FIG. 24, for example, extend down below the base by about 2½ or 2¾ inches, with the height of the unit when the legs are folded under it being about 13⅞ inches. Thus, when the legs are extended, the unit is about 16½ or 16⅝ inches high. The normal height of kitchen cabinets above the counter is between 15 and 16 inches. Accordingly, when the countertop cooler unit of FIGS. 22 through 29 is on a counter, and extends under the cabinets, the legs must be folded down. Under these conditions, the dispensing spigot is less than three inches above the base level, so the unit must be moved to the edge of the counter to fill taller glasses or other receptacles, or short glasses or mugs used to receive water from the spigot. Accordingly, the legs provide desired adaptability to raise the unit so the spigot is about 5½ inches above the base level, when the cooler is mounted in a location where the cabinet height constraint is not a factor. With this additional height, normal height glasses may be readily filled from the spigot.

Reference will now be made to FIG. 1 and the thermoelectric cooling device unit 70. Thermoelectric cooling devices such as 70 operate as a solid state heat pump. The cold junction of the device is that junction which will absorb or remove heat from an intended "cold surface" such as inner conductive surface 26. The heat absorbed at the cold junction, which is in intimate contact with a thermally conductive member such as aluminum member 23, is pumped to the hot junction at a rate proportional to the current passing through the circuit. Thermoelectric cooling couples may be made using two elements of semiconductors, such as Bismuth Telloride, heavily doped to create either an excess (N type) or deficiency (P type) of electrons. Current flowing through a series circuit will cool one junction and heat on another junction in accordance with known thermoelectric principles. Thermoelectric cooling elements are available from various sources, including MELCOR, Materials Electronic Products Corp., 994 Spruce Street, Trenton, NJ 08648, USA.

The hot junction will usually be a large metal or other heat conductive material which may diffuse the heat. In FIG. 1, housing 72 and chamber 74 in combination with fan system 60 conduct the heat away from the hot junction. The thermoelectric device can be attached with the hot junction in contact with a conductive member in which a water bottle is held in intimate contact therewith, in order to heat the water. Such a configuration is utilized for the hot water section 410 of embodiment 400, see FIG. 16.

The conductive member, such as 23, would preferably be made from either aluminum alloys or magnesium alloys, or other goods thermal conductors could be used. The conductive members could also be multi-layered composites of various material compositions or composed of a single material high thermal conduction properties.

The embodiment of FIG. 1, is envisioned for use both in the kitchen, as well as on the go. As shown in position "A" of FIG. 15, the lock handle 50 in position "A" will lock upper removable section 25 in place with lower section 27 and allow carrying of the unit by the handle. The intimate contact and overlay of locking flanges 101 and 103 (not shown) of lock handle 54 onto lock flanges 102 and 104 (not shown) on upper removable section 25 will ensure the secure closure of enclosure 21. The embodiment in FIG. 1, as others herein, are contemplated to also be able to run on batteries. The batteries would run the cooling device, such as 70, and allow for a truly portable unit. The small size of the unit will permit its use on long trips, camping, and for picnics. The units may of course be operated from car or camper batteries.

The outer surfaces will be constructed of thin walled molded lightweight plastic with the insulation between the outer surface and the inner surface conductive member to be lightweight insulation. The base and base plate if desired, could also be of lightweight molded plastic, lightweight aluminum alloys, or magnesium alloys with the thickness being sufficient to support the enclosure.

The embodiments shown herein and any alternatives are envisioned for use with a battery pack to supply power to either the thermoelectric cooling system or a traditional refrigeration system. Such battery operation will show a continuous operation of the countertop cooling unit as well as its potential portable uses on long trips and for camping environments, particularly when power is available from automotive vehicles or marine craft.

All embodiments are contemplated to have a height of no more than 15½ inches, without the extending legs, as discussed above. The typical distance from the countertop to beneath the typical kitchen cabinet is approximately 16 inches. All embodiments of the countertop cooling unit are envisioned to be placed on a countertop underneath the cabinet in a typical kitchen; utilizing a minimum amount of counterspace.

Having thus described preferred exemplary embodiments of countertop cooling units that illustrate the present invention, various alternatives may be implemented. Thus, by way of example and not of limitation, liquids other than water may be cooled, and bottles other than 2½ gallon bottles may be cooled. Various other modifications, alterations and adaptations thereof may be made within the scope of the present invention which is defined by the following claims.

What is claimed is:

1. A liquid chiller or countertop cooler for standard size water bottles or the like comprising:

an enclosed refrigeration case for removably receiving and closely enclosing a plastic water bottle approximately 6 inches wide, 12 inches deep, and 10 inches in height, said bottle having a dispensing spigot mounted at the lower front end thereof;

said case including a base, said enclosed case having a lower section fixed to said base and a fully removable top section including a portion covering more than one-half of the top of said bottle, and most of the front thereof, to permit placement of said bottle in said enclosed refrigeration case and to allow for the removal of said bottle therefrom;

means for mounting said removable section in place to enclose said refrigeration case;

a thermally conductive metal member covering the inner rear of said case, and extending along at least a substantial portion of the inner rear of said case, and at least one adjacent inner wall of said refrigeration case, to cool said bottle by conduction;

thermoelectric cooling means mounted at the rear of said refrigeration case and in intimate thermal conductive relationship with said conductive metal member for cooling the water in said bottle;

said refrigeration case including a spigot receiving opening extending through the front wall of the lower fixed section thereof, whereby the bottle must be placed into said countertop cooler with the spigot being initially engaged through said opening before the remainder of the bottle can be placed into said cooler; and means including downwardly extendable or foldable legs mounted under said base for varying the height of said countertop cooler from a relatively low height which will easily fit under kitchen cabinets to a higher elevation for greater convenience in filling tall receptacles.

2. A liquid chiller or countertop cooler for standard size water bottles or the like as defined in claim 1 further including plug means for sealing said spigot receiving opening.

3. A liquid chiller or countertop cooler for standard size water bottles or the like as defined in claim 1 further comprising means including an air flow channel extending to a space under said cooler, for removing heat from a hot junction associated with said thermoelectric cooling means.

4. A liquid chiller or countertop cooler for standard size water bottles or the like as defined in claim 1 wherein the edges of said lower section and said upper section are provided with mating grooves and ridges to firmly engage one-another.

5. A liquid chiller or countertop cooler for standard size water bottles or the like as defined in claim 1 wherein said legs extend approximately two to four inches below the base surface of said cooler when said legs are in the extended configuration.

6. A liquid chiller or countertop cooler for standard size water bottles or the like as defined in claim 1 wherein said cooler is provided with two pivoted legs, one at the front and one at the back of said cooler, each of said legs extending transversely across a substantial portion of the width of said cooler.

7. A liquid chiller or countertop cooler for standard sized water bottles or the like comprising:

a plastic water bottle approximately 6 inches wide, 12 inches deep, and 10 inches in height;

said plastic bottle having a spigot mounted on said bottle at the lower front end thereof;

a refrigeration case which closely encapsulates said plastic water bottle, said case having a fully removable upper portion and a lower fixed portion;

said case having a cooling means for conductively cooling said water and said plastic water bottle;

said case having a multi-layered material construction which incorporates in its interior in intimate contact with said plastic water bottle, a thermally conductive metal liner, extending across the back and at least one adjacent wall of said cooler;

incorporated within the walls of said case, as the layer contacting said interior, is insulated material which prevents the loss of coolness from the water in said plastic water bottle;

the exterior of the case being comprised of rigid dense material of sufficient structural strength to support and enclose said plastic water bottle, said water therein, said insulation, and said metal liner;

said refrigeration case including a spigot receiving opening toward the front of the lower fixed portion thereof, whereby the bottle must be placed into said countertop cooler with the spigot being initially engaged through said opening before the remainder of the bottle is placed into said cooler; and means including downwardly extendable or foldable legs mounted under said base for varying the height of said countertop cooler from a relatively low height which will easily fit under kitchen cabinets to a higher elevation for greater convenience in filling tall receptacles.

8. A liquid chiller or countertop cooler for standard size water bottles or the like as defined in claim 7 further including plug means for sealing said spigot receiving opening.

9. A liquid chiller or countertop cooler for standard size water bottles or the like as defined in claim 7 further comprising means including an air flow channel extending to a space under said cooler, for removing heat from a hot junction associated with said thermoelectric cooling means.

10. A liquid chiller or countertop cooler for standard size water bottles or the like as defined in claim 7 wherein the edges of said lower section and said upper section are provided with mating grooves and ridges to firmly engage one-another.

11. A liquid chiller or countertop cooler for standard size water bottles or the like as defined in claim 7 wherein said legs extend approximately two to four inches below the base surface of said cooler when said legs are in the extended configuration.

12. A liquid chiller or countertop cooler for standard size water bottles or the like as defined in claim 7 wherein said cooler is provided with two pivoted legs, one at the front and one at the back of said cooler, each of said legs extending transversely across a substantial portion of the width of said cooler.

13. A liquid chiller or countertop cooler for standard size water bottles or the like comprising:

an enclosed refrigeration case for removably receiving and closely enclosing a plastic water bottle approximately 6 inches wide, 12 inches deep, and 10 inches in height, said bottle having a dispensing spigot mounted at the lower front end thereof;

said case including a base, said enclosed case having a lower section fixed to said base and a fully removable top section including a portion covering more than one-half of the top of said bottle, and most of the front thereof, to permit placement of said bottle in said enclosed refrigeration case and to allow for the removal of said bottle therefrom;

means for mounting said removable section in place to enclose said refrigeration case;

a thermally conductive metal member covering the inner rear of said case, and extending along at least a substantial portion of the inner rear of said case, and at least one adjacent inner wall of said refrigeration case, to cool said bottle by conduction;

thermoelectric cooling means mounted at the rear of said refrigeration case and in intimate thermal conductive relationship with said conductive metal member for cooling the water in said bottle;

said refrigeration case including a spigot receiving opening extending through the front wall of the lower fixed section thereof, whereby the bottle must be placed into said countertop cooler with the spigot being initially engaged through said opening before the remainder of the bottle can be placed into said cooler; and sealing plug means for closing said spigot receiving opening to permit use of said cooler for purposes other than cooling standard size water bottles.

14. A liquid chiller or countertop cooler for standard size water bottles or the like comprising:

an enclosed refrigeration case for removably receiving a water bottle;

said case including a base, said enclosed case having a lower section fixed to said base and a fully removable top section including a portion covering more than one-half of the top of said bottle, and most of the front thereof, to permit placement of said bottle in said enclosed refrigeration case and to allow for the removal of said bottle therefrom;

means for mounting said removable section in place to enclose said refrigeration case;

a thermally conductive metal member covering the inner rear of said case, and extending along at least a substantial portion of the inner rear of said case, and at least one adjacent inner wall of said refrigeration case, to cool said bottle by conduction;

thermoelectric cooling means mounted at the rear of said refrigeration case and in intimate thermal conductive relationship with said conductive metal member for cooling the water in said bottle;

said refrigeration case including a spigot receiving opening extending through the front thereof; and means including downwardly extendable or foldable legs mounted under said base for varying the height of said countertop cooler from a relatively low height which will easily fit under kitchen cabinets to a higher elevation for greater convenience in filling tall receptacles.

15. A liquid chiller or countertop cooler for standard size water bottles or the like as defined in claim 14 further including plug means for sealing said spigot receiving opening.

16. A liquid chiller or countertop cooler for standard size water bottles or the like as defined in claim 14 wherein the edges of said lower section and said upper section are provided with mating grooves and ridges to firmly engage one-another.

17. A liquid chiller or countertop cooler for standard sized water bottles or the like comprising:

a refrigeration case for closely enclosing a plastic water bottle, approximately 6 inches wide, 12 inches deep, and 10 inches in height, said plastic bottle having a spigot mounted on said bottle at the lower front end thereof;

said case having a fully removable upper portion and a lower fixed portion;

said case having a cooling means for conductively cooling said water and said plastic water bottle;

said case having a multi-layered material construction which incorporates in its interior in intimate contact with said plastic water bottle, a thermally conductive metal liner, extending across the back and at least one adjacent wall of said cooler;

incorporated within the walls of said case, as the layer contacting said interior and said metal liner, is insulated material which prevents the loss of coolness from the water in said plastic water bottle;

the exterior of the case being comprised of high strength material to support and enclose said plastic water bottle, said water therein, said insulation, and said metal liner;

said refrigeration case including a spigot receiving opening toward the front thereof; and said upper and lower portions of said cooler having mating edges which have mating grooves and ridges to firmly engage one-another.

18. A liquid chiller or countertop cooler for standard size water bottles or the like as defined in claim 17 wherein said cooler has downwardly extendable or foldable legs mounted under said base for varying the height thereof.

19. A liquid chiller or countertop cooler for standard size water bottles or the like as defined in claim 17 further including plug means for sealing said spigot receiving opening.

20. A liquid chiller or countertop cooler for standard size water bottles or the like as defined in claim 17 further comprising means including an air flow channel extending to a space under said cooler, for removing heat from a hot junction associated with said thermoelectric cooling means.

* * * * *

UNITED STATES PATENT AND TRADEMARK OFFICE

CERTIFICATE OF CORRECTION

PATENT NO. : 4,913,713

DATED : April 3, 1990

INVENTOR(S) : Richard S. Bender, et al

It is certified that error appears in the above-identified patent and that said Letters Patent is hereby corrected as shown below:

In the Abstract, line 4, "said water bottle enclodes" should read -- said water bottle enclosed--.

In the drawings, the Figure on the title page, and Figure 24 on Sheet 9 should appear as shown on attached sheet.

Signed and Sealed this

Twenty-seventh Day of August, 1991

*Attest:*

HARRY F. MANBECK, JR.

*Commissioner of Patents and Trademarks*

*Attesting Officer*

UNITED STATES PATENT AND TRADEMARK OFFICE

CERTIFICATE OF CORRECTION

PATENT NO. : 4,913,713

DATED : April 3, 1990

INVENTOR(S) : Richard S. Bender
Lawrence Pleet

It is certified that error appears in the above-identified patent and that said Letters Patent is hereby corrected as shown below:

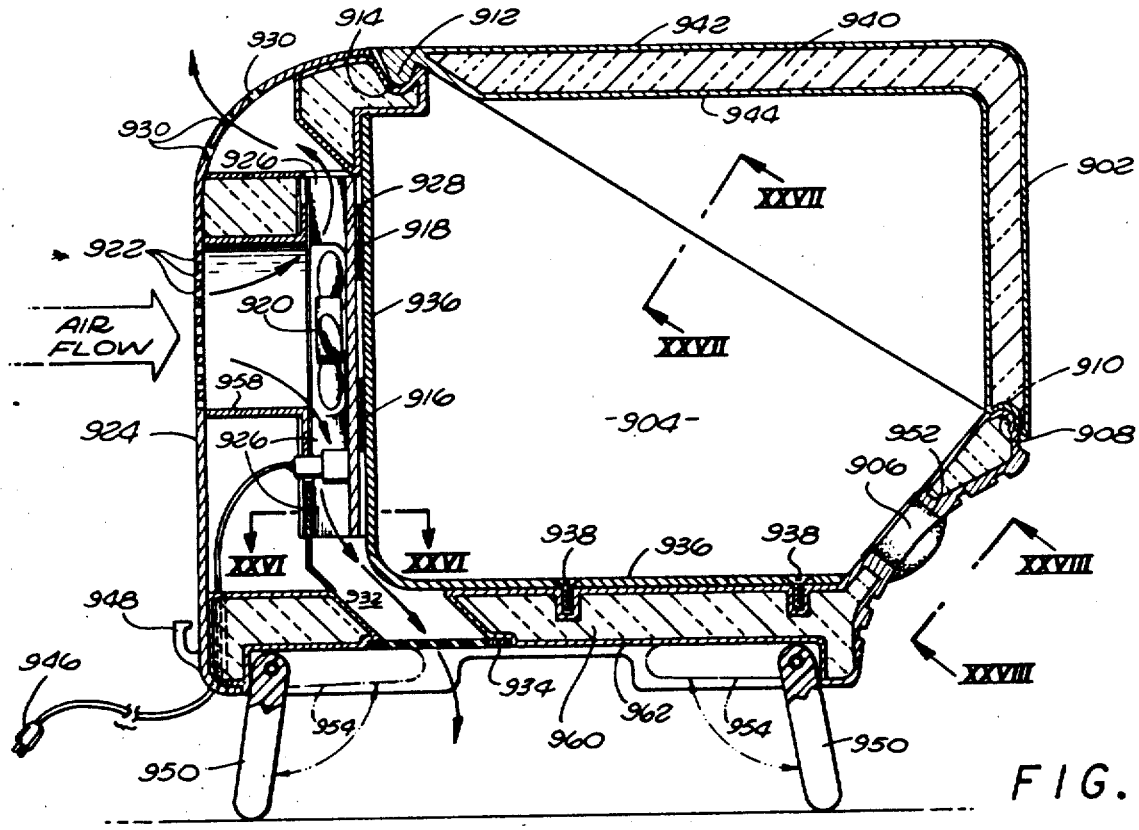

FIG. 24